US005443362A

United States Patent [19]

Crites et al.

[11] Patent Number: 5,443,362

[45] Date of Patent: Aug. 22, 1995

[54] AIR TURBINE

[75] Inventors: Timothy E. Crites; Douglas C. Barker; Joseph W. Clifford, all of North Canton; Darwin S. Crouser, Canton, all of Ohio

[73] Assignee: The Hoover Company, North Canton, Ohio

[21] Appl. No.: 213,735

[22] Filed: Mar. 16, 1994

[51] Int. Cl.[6] ..... F01D 1/08

[52] U.S. Cl. ..... 415/184; 415/186; 415/208.3

[58] Field of Search ..... 415/184, 186, 202, 208.3, 415/211.1, 214.1; 416/186 R; 417/407

[56] References Cited

U.S. PATENT DOCUMENTS

| | | | |
|---|---|---|---|
| 1,085,274 | 1/1914 | Loewenstein | 415/208.3 |
| 1,495,222 | 5/1924 | Clark . | |
| 2,000,930 | 5/1935 | DeNagy . | |
| 2,045,980 | 6/1936 | DeNagy . | |
| 2,078,634 | 4/1937 | Karlstrom . | |
| 2,731,022 | 1/1956 | Fischer et al. . | |
| 2,777,152 | 1/1957 | Cosentino . | |
| 2,881,466 | 4/1959 | Bramhall . | |
| 2,904,816 | 9/1959 | Skolfield . | |
| 2,904,817 | 9/1959 | Brennan . | |
| 2,930,069 | 3/1960 | Kowalewski . | |
| 2,962,748 | 12/1960 | Magarian . | |
| 3,285,187 | 11/1966 | Anderson, Jr. | 416/186 R |
| 4,589,161 | 5/1986 | Kochte et al. . | |
| 4,732,537 | 3/1988 | Kusz et al. | 415/202 |
| 4,859,144 | 8/1989 | Houston . | |

FOREIGN PATENT DOCUMENTS

| | | | |
|---|---|---|---|
| 83895 | 3/1989 | Japan | 415/211.1 |
| 847242 | 9/1960 | United Kingdom | 415/186 |

OTHER PUBLICATIONS

*Aerodynamics of Turbines and Compressors,* Princeton University Press, 1964, p. 534.

*Turbomachines,* John Wiley & Sons Inc., 1981, pp. 304, 315 and 318.

*Primary Examiner*—Edward K. Look

*Assistant Examiner*—James A. Larson

[57] ABSTRACT

An air turbine is provided having an entrance stator blade arrangement formed in two halfs, each containing a blade array, with the two halfs interleaved, upon turbine assembly, to thereby easily form an entrance stator with a multiplicity of entrance stator blades.

10 Claims, 5 Drawing Sheets

AIR TURBINE

BACKGROUND OF THE INVENTION

1. Field of the Invention

This invention relates to air turbines and, more particularly, to an air turbine having a fairly high multiple of stator blades.

2. Summary of the Prior Art

It is known to provide an entrance stator in an air turbine so as to more effectively and efficiently provide guidance for the air flowing therethrough. The use of a multi-bladed stator to more positively guide this airflow is also known. The number of blades to be utilized, particularly in entrance stators, of course would reach a finite limit when the blades were so overwhelming in number as to completely fill the slotting between them. There would then be no airflow to the turbine wheel. Below this limit, it has been found that a larger and larger number of entrance stator blades seems to increase power output. Solidity (the ratio of effective blade length to slot width) which theoretically has been set desirably at one can also be more easily effected with minimized overall turbine diameter by closely spaced, short entrance stator blading. Additionally, even a lower blade requirement presents problems in the forming of an entrance stator.

Accordingly, it is an object of this invention to provide a multiplicity of stator blades in an air turbine by interleaving a pair of stator bladed halfs.

It is an additional object of this invention to provide an air turbine with a relatively high number of stator blades.

It is still a further object of this invention to provide an entrance stator with an easily molded array of stator blades in an interleaving structural arrangement.

It is an additional object of this invention to provide stator blade interleaving by molding and then assembling individual bladed stator confronting sections.

It is a still further object of this invention to provide an improved stator arrangement in an air turbine.

It is a final object of this invention to provide an improved air turbine.

SUMMARY OF THE INVENTION

An air turbine is provided having a tangential inlet leading to an inlet stator array formed either by an enlarged housing shrouding piece or a relative flat throttling housing piece. The inlet stator is formed by two half sections one half having, ideally, half the blades and the other half having the other half. Upon assembly of the turbine these two stator half sections are put in confronting relationship with an interleaving of the blades occurring to yield a high blade multiple in the inlet stator. The interleaving is especially beneficial if the inlet stator is molded. The inlet stator half sections may be formed integral with the turbine housing or may be separate pieces inserted into it. The turbine wheel is also bladed and generally conventional. A centralized bladed outlet stator completes the structure of the turbine.

BRIEF DESCRIPTION OF THE DRAWINGS

Reference now may be had to the accompanying Drawings for a better understanding of the invention, both as to its organization and function, with the illustration showing a preferred embodiment, but being only exemplary, and in which.

DETAILED DESCRIPTION OF THE INVENTION

Figure 1:
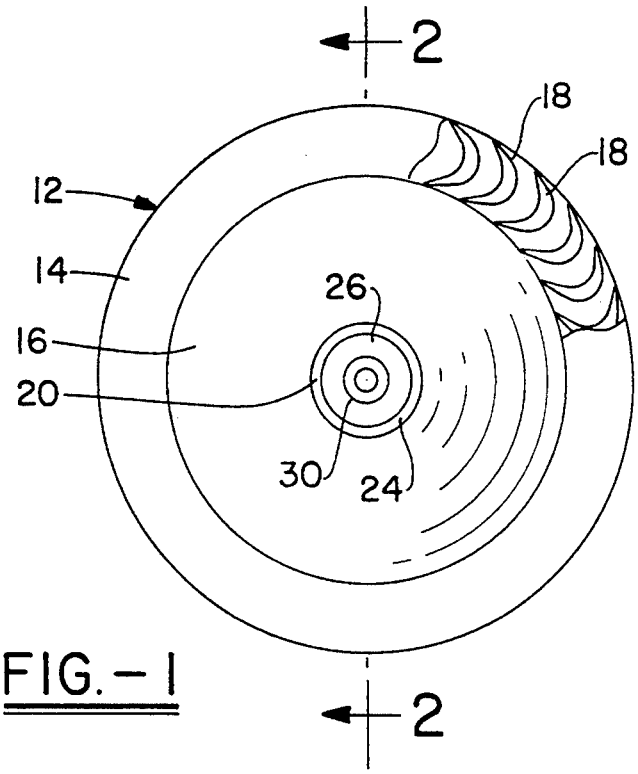
FIG. 1 is a plan view, partially broken away, of a turbine rotor forming a part of the invention.
Figure 2:
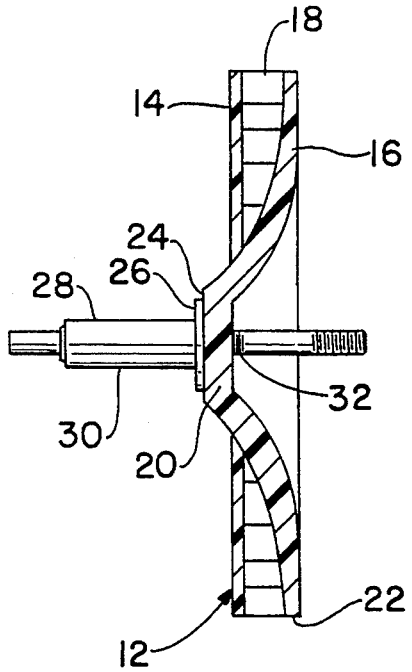
FIG. 2 is an elevational view, in partial cross-section, of the rotor shown in FIG. 1 as taken on line 2—2 thereof.
Figure 3:
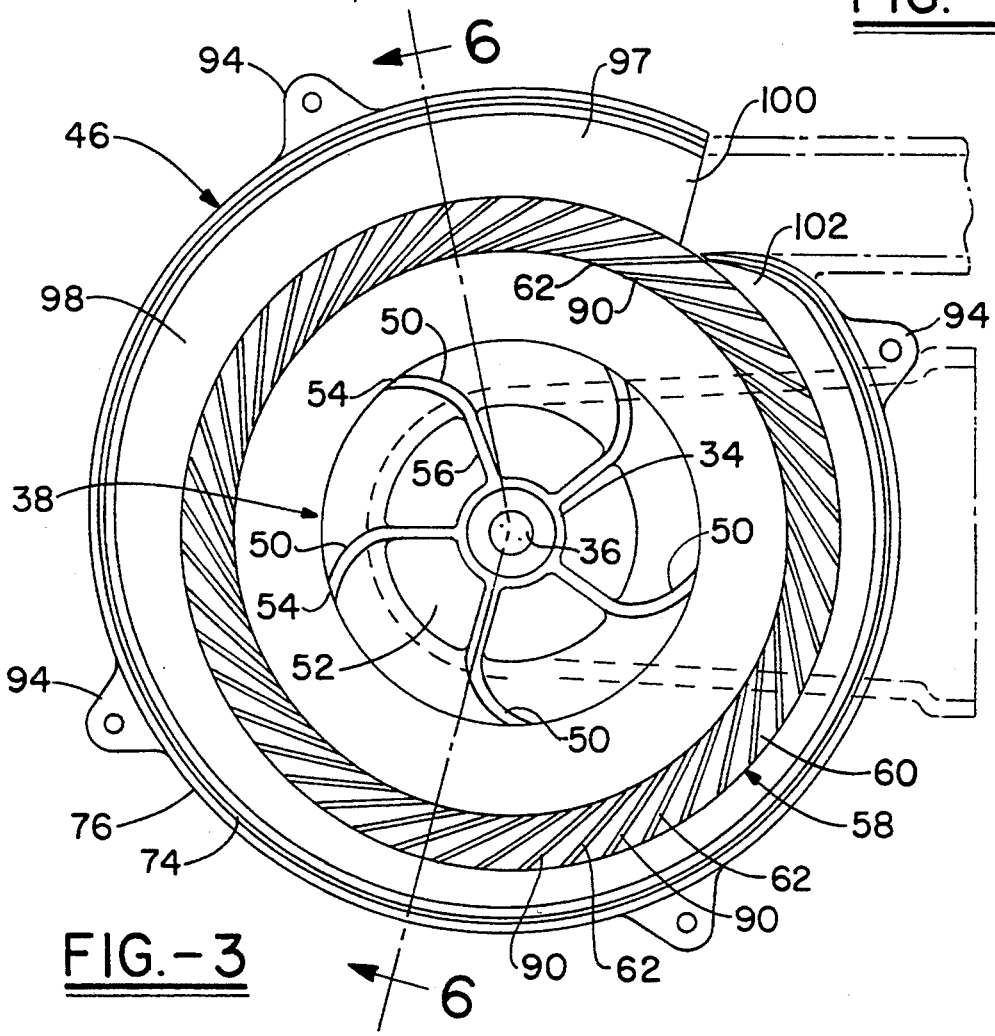
FIG. 3 is a plan view of the interior of one-half portion of the turbine housing and stator.
Figure 4:
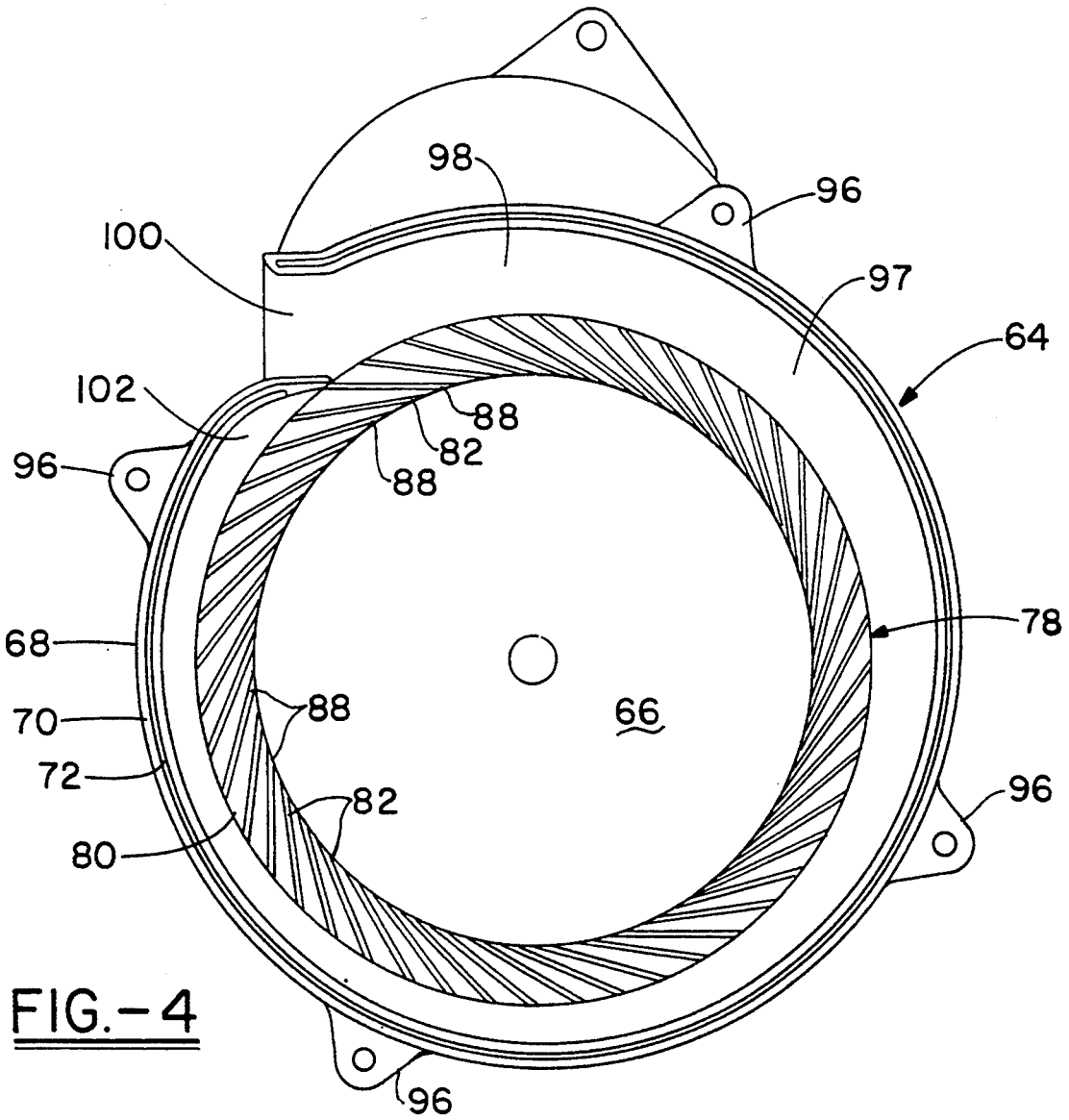
FIG. 4 is a plan view of the interior of the opposite one-half portion of the turbine housing and stator.
Figure 5:
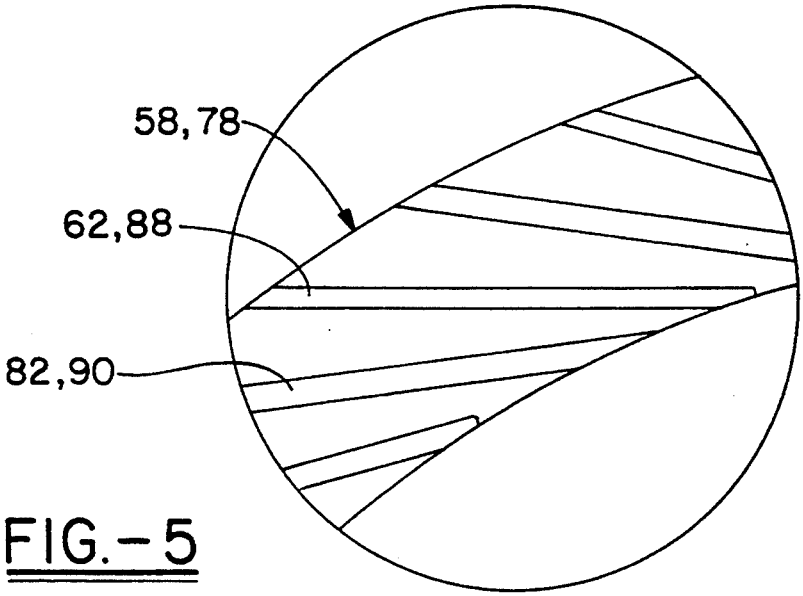
FIG. 5 is a partial exploded, greatly enlarged view showing vanes and grooves of a stator half to indicate how the stator halfs may be interleaved to form a completed stator.
Figure 6:
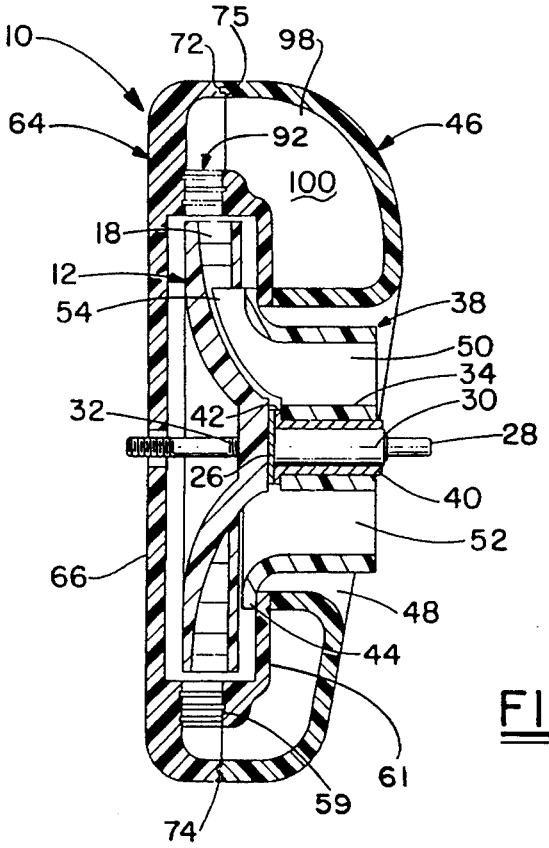
FIG. 6 is an elevational view, in partial cross-section, of a completely assembled turbine, the section being taken on line 6—6 of FIG. 3.

There is shown in FIGS. 1–6, a first embodiment of the invention comprising an air turbine 10 having an air driven turbine wheel 12 (FIGS. 1 and 2) formed, conventionally, with inner and outer wheel faces 14, 16 and scalloped, formed blades 18, 18 extending therebetween. The outer wheel face 16 is substantially continuous and includes a centrally located, somewhat truncately smoothly cone shaped section which extends inwardly in a streamlined manner from an outer rim 22 of the wheel face 16. Cone shaped section 20 extends inwardly beyond the plane of the inner wheel face 14 which takes the general form of a flattened hollow ring. This provides a terminating face 24 for the air driven turbine wheel 12 against which an integral flat disk 26 of a mounting shaft 28 abuts.

The mounting shaft 28 also includes an enlarged diameter section 30 inwardly of the flat disk 26 of mounting shaft 28 to provide a bearing surface for air driven turbine wheel 12. This shaft is mounted in the air driven turbine wheel 12 by an integral slightly enlarged threaded portion 32 which is received in a threaded bore (not shown) in air driven turbine wheel 12.

The air driven turbine wheel 12 and attached shaft 28 are mounted in air turbine 10 (FIG. 6) by means of a centrally located boss 34 having a through bore 36 and integral with exit stator 38. The through bore 36 receives a sleeve bearing 40 of hollow cylindrical shape therearound and made of brass or the like. It is press fit in the bore 36 so to be maintained therein and is disposed in closely surrounding relationship to the enlarged diameter section 30 of mounting shaft 28 to pilotingly receive this shaft in a rotating relationship. The sleeve bearing 40 includes an outturned end flange 42 against which a face of flat disk 26 on shaft 28 abuts to thereby limit inward movement of the air driven turbine wheel 12 towards exit stator 38.

Exit stator 38 includes an inner, outwardly turned lip 44 which is sealingly glued or the like to an inner, exit two piece, conventionally connected by any means turbine housing half 46. It is disposed centrally thereof in a central opening 48 in this housing half to extend outwardly from turbine housing half 46. It includes a conventional series of five or more, fixed stator blades 50, 50, 50, 50, 50 disposed equidistantly within an exit opening 52 in the exit stator 38. These blades are arranged to provide a spider centered on fixed stator boss 34 and extending outwardly from it to outturned flange 42. Each of the blades includes an inner turning portion 54 joining with the outturned edge 42 and extending linearly and axially parallel from a point slightly inwardly therefrom to form an axially extending guiding portion 56 joined to the inner turning portion 54. The guiding portion 56 terminates at the outer face of fixed stator boss 34. No further description of this exit stator is given since its structure is conventional and well known.

Mounted within turbine exit housing half 46 is an inlet stator ring 58 having a cylindrical ring-like surface 60 on which are mounted integral axially extending blades 62. These blades, conventionally, are angled to turnably move air from the air turbine entrance (to be described) and then to discharge the air to air driven turbine wheel 12. The stator ring 58 is mounted centered on the exit opening 52 in the exit stator 38 within the exit turbine half on a flat face 59 formed on an inwardly extending projection 61 of turbine housing half 46. The central opening 48 is centered in the projection 61. The ring-like surface 60 of the inlet stator ring 58 is an integral molded continuation of the flat face 59.

A second, entrance half 64 of air turbine 10 is of generally cylindrical shape and includes a relatively flat side 66 bordered by an inturned cylindrical flange 68. This flange terminates in a flat 70 that has a circular groove 72 for the lodgment of an axially extending cylindrical tab 74 formed in a flat 75 on a cylindrical flange 76 of exit turbine housing half 46. The turbine halfs 46, 64 mate at the circular groove 72 and the axially extending cylindrical tab 74, with the flat 70 of cylindrical flange 68 of entrance turbine housing half 64 abutting the flat 75 of flange 76 of exit turbine housing half 46. This structure provides a generally sealed housing for air turbine 10.

The second entrance housing half 64 of air turbine 10 mounts an integral second inlet stator ring 78 that includes a flat cylindrical ring-like section 80 having a series of axially extending angled blades 82, 82. This ring-like section is integral with and forms a continuation of the inside face of the flat side 66 of turbine housing half 64. Thus, so the inlet stator 78 will remain stationary within the air turbine 10.

When the two turbine housings halfs 46, 64 are to be assembled, the air driven turbine wheel 12 is first assembled with the housing half 46. The entrance stator rings 58, 78 are interleaved when the turbine housing halfs 46, 64 are placed in abutting assembled condition. When the inlet stator blades 62 and 82 interleave, the blades 62 nest in grooves 88 in backing piece 80 of inlet stator ring 78 and the blades 82 nest in grooves 90 in backing piece 60 of inlet stator ring 58. A total inlet stator 92 is thereby formed with fairly closely spaced blades and limited leakage and without the necessity of attempting to mold all the blades in one molded piece.

The air turbine, once assembled in this manner, may be bolt and nut connected together with the use of holed tabs 94, 94, 94 on turbine housing half 46 and holed tabs 96, 96, 96 on turbine housing half 64.

The air turbine 10 is provided with an air volute 97, formed by the two housing halfs 46, 64 and including an entrance passageway 98 which leads into a volute of diminished size as it extends, essentially, nearly completely around the total inlet stator 92. It thereby has both an enlarged inlet 100 and a thinned terminating tip 102. It diminishes in both axial height and tangential width (FIG. 6) as it moves from its enlarged inlet 100 to its thinned terminating tip 102. This provides, as is conventional, a better defined air guide flow path since more and more air leaves the air entrance passageway 98 to enter the total entrance stator 92 as it passes around the turbine 10 to thereby be guided to the air driven turbine wheel 12.

In the second and the later described preferred embodiment, like numbers are utilized to indicate like elements as in the first embodiment and primed and double primed and triple primed numbers are utilized to illustrate modified elements.

Figure 7:
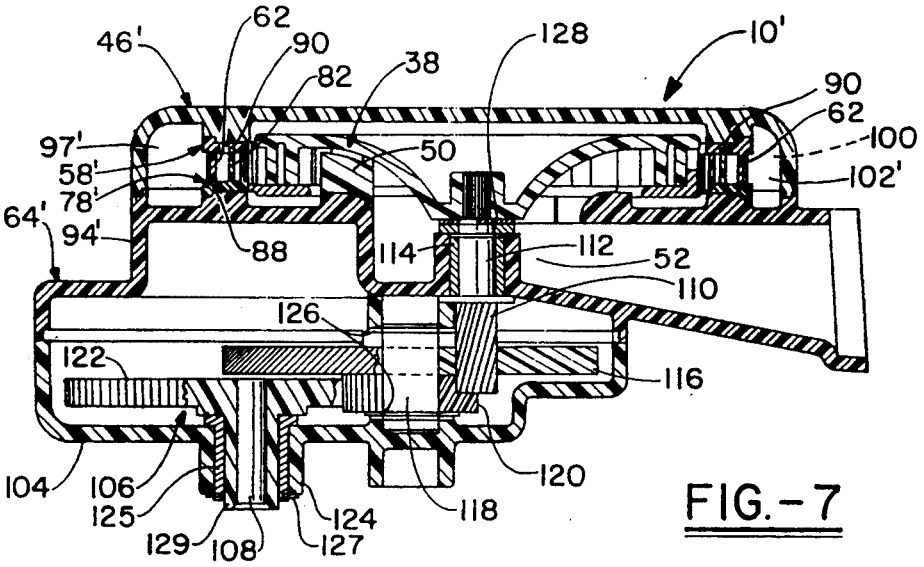
FIG. 7 is a cross-sectional elevational view, similar to this showing of FIG. 6, but of a second embodiment of an air turbine which also incorporates interleaved stator halfs and is adapted for driving a brush.

The second embodiment of the invention is shown in FIG. 7. It includes a gear train useful for driving agitator brushes or the like. In it, an air turbine 10' is seen to have outlet and inlet turbine housing halfs 46' and 64' which mate together in a manner similar to the first embodiment and which may be fixedly held in this position by any conventional means (not shown).

The exit stator housing half 46', in this embodiment, is somewhat flattened or pancaked to reduce the size of its air entrance volute 97' as it leads around the periphery of the turbine housing halfs 46', 64'. This provides throttling and reduced performance for the air turbine, if desired. It also mounts an inlet stator ring 58' having integral blades 62 between blade receiving grooves 90, disposed on each side of it. The stator ring 58' is a separate piece and not molded into turbine housing half 46' so it must be prevented from relative rotation to it by the application of adhesive or keying or the like at assembly.

The outlet turbine housing half 46' also mounts an exit stator 39 having exit stator blades 50 with an exit opening 52 and an air driven turbine wheel 12 having blades 18.

The inlet turbine housing half 64' provides for lodgement of the second inlet stator ring 78' including blades 82 and blade receiving grooves 88. This stator ring is also a discrete piece and must be adhesively assembled to turbine housing half 64' to prevent relative rotation between these parts during actual air turbine 10' operation or be keyed in proper orientation to align one blade to the inlet housing structure, thus preventing air leakage and recirculation of air in the involute chamber. When assembled the inlet stator blades 62, 82 on the turbine housing halfs 46', 64', respectively, interleave as in the first embodiment.

The entrance turbine housing half 64' is provided with an enlarged lower disk shaped portion 104 within which is mounted a gear train 106 having an output shaft 108 which may be connected to a cleaning brush or the like (not shown).

The gear train 106 includes at its input end a pinion gear 110 formed on the end of a shaft 112 press fit into air driven turbine wheel 12. A sleeve bearing 114 surrounds the shaft 112 and pilotingly maintains this shaft in a pilot boss 34' integral with lower turbine housing half 64'. The pinion gear 110 meshes with a large driven spur gear 116 which is fixed to a shouldered stub shaft 118 that is piloted in hollow bosses in disk shaped portion 104 of turbine housing half 64'.

Below the large spur gear 116, a smaller driving spur gear 120 is also mounted fast on shaft 118. This gear, in turn, meshes with a brush drive gear 122 disposed sidewardly axially of it and mounted in a hollow boss 124 extending outwardly at the bottom of the disk shaped portion 104 of entrance turbine housing half 64'. A sleeve bushing 125 is pressed into the housing and the gear 122 is axially retained by a circlip 127. It also includes an integral boss shaft 129.

A series of thrust washers, e.g., thrust washers 126, 126 and 128 in the gear train 106 limit shaft and gear movement axially.

Figure 8:
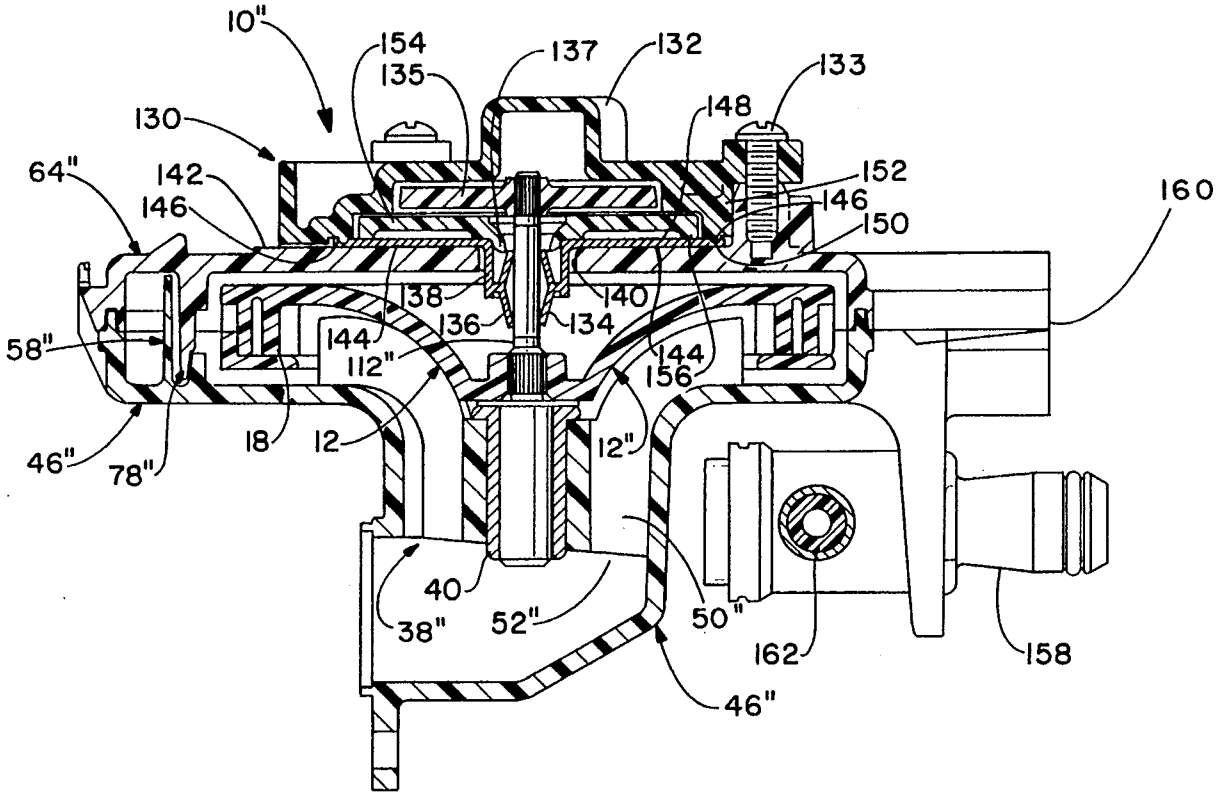
FIG. 8 is also a cross-sectional elevational view, similar to FIG. 6, but of a third and preferred embodiment which also incorporates interleaved stator halfs and is adapted for driving a pump.

A third and preferred embodiment is shown in full cross-sectional, elevational view in FIG. 8 and includes provision for driving an attached pump turbine. The air turbine 10'' includes exit housing half 46'' and turbine inlet housing half 64'' held mounted together by any desired conventional means such as plastic loops and one way angled catches (not shown). An exit stator 38'' including blades 50'' is mounted therein as is an air driven turbine wheel 12''. A sleeve bearing 40 provides for unimpeded rotation of the turbine wheel 12''.

A pair of inlet stator rings 58'', 78'' are provided integrally in the turbine housing halfs by molding the turbine's blades therein so that, upon air turbine assembly blades 62'', in turbine housing half 46'' interleave with blades 82'' on turbine housing half 64''. Each of the blades, however, has a distinctly different shape than the blades of the first two embodiments since each blade is stepped longitudinally in an axial direction. This arrangement will be described later.

Exit stator 38'' includes an exit opening 52'', while air turbine 10'' also has an entrance 100''. The exit housing turbine half 46'' is again pancaked to eliminate a bulbous volute so that a relatively small cross-sectional area volute 97'' is obtained.

A driving shaft 112'' is press fit into air driven turbine wheel 12'' to extend outwardly therefrom and into a pump 130. The pump 130 has a housing 132 tightly attached to the air turbine 10'' by boss mounted screws 133, 133, 133, 133 (only one shown). Mounted within the pump 130 is a pump impeller 135 which is press fit on the other end of driving shaft 112''. A seal is effected between the pump 130 and air turbine 10'' as the shaft 112'' passes between them by a double seal 134, taking the form of two oppositely directed frustro-conical pieces 136, 136 which embrace the circumferential perimeter of drive shaft 112''.

The double seal 134 includes a boss-like reinforcing stub 138 which joins axially medially to the periphery of the double seal 134 to position it fixedly adjacent the interface between the pump 130 and the air turbine 10''. This boss extends loosely through an aperture 140 in a bottom wall 142 of turbine inlet housing half 64'' to allow the double seal to centrally locate on the shaft rather than on the housing half 64''.

The boss 138 is integrally joined to a flat disk-like piece 144 extending radially outwardly from the boss and carrying an annular sealing groove 146 near its outer periphery, formed in an outer face 148 of disk-like piece 144. This groove receives a mirror image, annular sealing bead 150 on an inner inwardly facing flange 152 on pump housing 132. A reinforcement plate 154 is disposed between boss carrying flat disk-like piece 144 and the pump impeller 135 to prevent the radially extended portion of the seal from contacting the pump impeller during operation. To this end, reinforcement plate 154 carries an inwardly directed rim 156 that abutting engages the disk-like piece 144 near its periphery It is radially located on the seal by a protrusion 137 engaging the hollow center of the seal boss 138 during assembly. Neither the pump entrance or pump discharge is shown; but they may be conventionally provided. It should be noted that the disclosed pump forms no part of the instant invention.

A quick disconnect coupling 158 is mounted with the air turbine 10'' beside an air turbine entrance tube 160 leading to entrance 100'' of air turbine 10''. This coupling communicates with a hose 162 that loopingly extends (not shown) to the discharge side (not shown) of pump 130.

Figure 9:
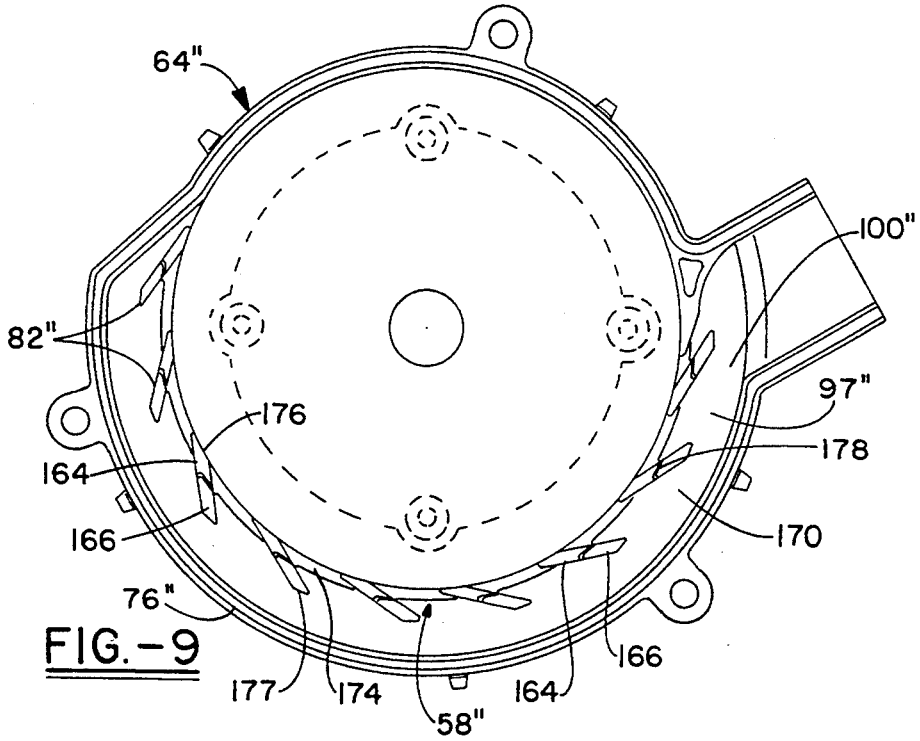
FIG. 9 is a plan view of the entrance turbine half of the FIG. 8 embodiment.
Figure 10:
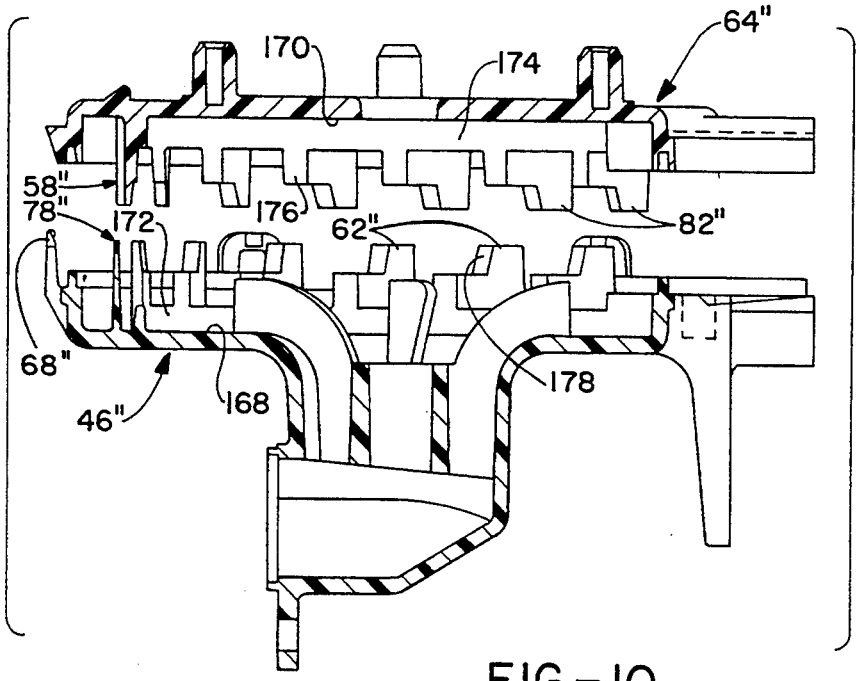
FIG. 10 is a cross-sectional view of both turbine housing halfs of the FIG. 8 embodiment and just prior to engaging assembly.

As previously pointed out, each of angled stator blades 62'', 82'' (FIGS. 9 and 10) is stepped to provide a short step 164, 164 and an adjoining integral 166, 166 long step. Each of the longer steps 166, 166 is disposed radially outwardly relative to its short step 164. When assembled together the long steps 166, 166 closely abut flats 168, 170 on the outlet turbine housing halfs 46'', 64'', respectively. The short stator blade steps 164, 164 engage against rim beads 172, 174, also integral with the turbine housing halfs 46'' and 64''. The rim beads 172, 174 are disposed inboard of the blade long steps 166, 166 and, essentially, are situated with their inner cylindrical side defined by the inner termination 176 of each of blade short steps 164, 164. This termination is tapered to provide smoother airflow by melding into each of its integral and abutting rim beads, e.g., beads 172, 174. A similar taper is provided by an outer termination 177 for each of the long blade steps 166, 166. A riser 178 for each stepped blade 62'', 82, separating the long and short steps 166, 164, e.g., is provided with draft so as be easily moldable. This riser completes the outline of each of the blades 62'', 82''. Again, the entrance stator blades are easily molded since the blades are interleaved within the two housing halfs.

The rim beads 172, 174 provide additional throttling for air turbine 10'' above that afforded by its pancake shape to thereby more closely match the power input requirements of pump 130. The outer flanges 68'', 76'' on inlet turbine housing half 64'' and outlet turbine housing half 46'' provide a seal for the air turbine 10'''. They radially veer inwardly in the area where there are no respective blade arrays which only extend partly around their housing half (e.g., turbine housing half 64''—FIG. 9). This provides additional throttling for the air turbine 10''.

It should now appear clear that all the objects of the invention set out in the beginning portion of the description have been satisfied. It should also be obvious that many modifications could be made to it which would still come within its purview. For example, one of the stator rings on each turbine could be a separate subassembly and the other integral with its housing half or non-stepped blades could be used in an embodiment like the preferred one if additional throttling was not desired.

What is claimed is:

1. An air turbine including:

a) a turbine housing;

b) an inlet and an outlet for said housing;

c) a turbine rotor disposed in said turbine housing between said inlet and said outlet;

d) a stator also disposed in said turbine housing between said inlet and outlet;

e) said stator formed of two confronting pieces having oppositely extending stator blades; and f) said stator blades being interleaved whereby stator blading may be more easily provided in said turbine housing.

2. The air turbine of claim 1 wherein:

a) said turbine housing is segmented.

3. The air turbine of claim 2 wherein:

a) said oppositely extending blades are made integral with said turbine housing.

4. The air turbine of claim 2 wherein:

a) said oppositely extending blades are formed on stator rings; and b) said stator rings are separately mounted within said segments of said turbine housing.

5. The air turbine of claim 1 wherein:

a) said oppositely extending stator blades having free ends that nest in grooves formed in said confronting pieces.

6. The air turbine of claim 1 wherein:

a) said turbine housing includes an enlarged bulbous shaped scroll forming said inlet.

7. The air turbine of claim 1 wherein:

a) said housing includes a flat, pancake shaped housing section limiting inward airflow to throttle said turbine to thereby reduce its power output.

8. The air turbine of claim 1 wherein:

a) said confronting pieces are formed by molding.

9. The air turbine of claim 1 wherein:

a) said stator blades are stepped longitudinally in an axial direction.

10. The air turbine of claim 9 wherein:

a) said blades each include axially longer and axially shorter portions; and b) said shorter portions abut against rims formed in said turbine housing.

* * * * *